US005328789A

United States Patent [19]

Nakamori et al.

[11] Patent Number: 5,328,789

[45] Date of Patent: Jul. 12, 1994

[54] ELECTROPHOTOGRAPHIC ORGANIC PHOTOCONDUCTOR

[75] Inventors: Hideo Nakamori; Masashi Tanaka, both of Osaka, Japan

[73] Assignee: Mita Industrial Co., Ltd., Osaka, Japan

[21] Appl. No.: 64,705

[22] Filed: May 20, 1993

[30] Foreign Application Priority Data

May 25, 1992 [JP] Japan ..... 4-132840

[51] Int. Cl.[5] ..... G03G 5/047; G03G 5/09

[52] U.S. Cl. ..... 430/58; 430/59; 430/83

[58] Field of Search ..... 430/58, 59, 83

[56] References Cited

U.S. PATENT DOCUMENTS

| | | | |
|---|---|---|---|
| 5,166,016 | 11/1992 | Badesha et al. | 430/58 X |
| 5,168,026 | 12/1992 | Miyamoto | 430/73 |
| 5,176,976 | 1/1993 | Kikuchi et al. | 430/58 |
| 5,213,923 | 5/1993 | Yokoyama et al. | 430/70 X |
| 5,213,924 | 5/1993 | Sakamoto | 430/58 |
| 5,213,926 | 5/1993 | Hanatani et al. | 430/59 |

FOREIGN PATENT DOCUMENTS

| | | |
|---|---|---|
| 0449565 | 10/1991 | European Pat. Off. . |
| 0506387 | 9/1992 | European Pat. Off. . |
| 1206349 | 8/1989 | Japan . |

OTHER PUBLICATIONS

Yamaguchi et al., "New Electron Transporting Organic Compounds, Diphenoquinone Derivatives, and their Application to Xerographic Photoreceptors", pp. 280–290, The Sixth International Congress on Advances in Non-Impact Printing Technologies, Oct. 21–26, 1990.

*Primary Examiner*—Roland Martin

*Attorney, Agent, or Firm*—Renner, Otto, Boisselle & Sklar

[57] ABSTRACT

An electrophotographic organic photosensitive layer is formed by using a diphenoquinone derivative A and a diphenoquinone derivative B having a larger absolute value for reduction potential as electron transport materials. The diphenoquinone derivative A is, for example, 3,5-dimethyl-3',5'-di-t-butyl-4,4'-diphenoquinone. The diphenoquinone derivative B is, for example, 3,3',5,5'-tetra-t-butyl-4,4'-diphenoquinone. The diphenoquinone derivative B is included in the proportion of 3 to 50 wt % on the basis of the total weight of the electron transport materials (the diphenoquinone derivatives A and B).

18 Claims, 2 Drawing Sheets

ELECTROPHOTOGRAPHIC ORGANIC PHOTOCONDUCTOR

BACKGROUND OF THE INVENTION

1. Field of the Invention

The present invention relates to an electrophotographic organic photoconductor used in a copying machine, a laser printer and the like. More particularly, the present invention relates to a monolayer type electrophotographic organic photoconductor which can be charged with a desired polarity, i.e., either positively or negatively, and has a small residual potential and an improved sensitivity.

2. Description of the Related Art

In an electrophotographic copying machine using a digital optical system, the light source generally has a wavelength of 700 nm or more. As a photoconductor having a sensitivity in this wavelength region, an organic photoconductor (OPC), an amorphous silicon ($\alpha$-Si) photoconductor, a selenium photoconductor and the like are known. Among them, the organic photoconductor is mostly used because of its high sensitivity and low cost.

The following two types of organic photoconductors are known: A so-called function separate type organic photoconductor in which a charge generation layer (hereinafter referred to as the "CGL") and a charge transport layer (hereinafter referred to as the "CTL") are laminated onto each other, that is, a multi-layer type photoconductor; and a monolayer type photoconductor having a photosensitive layer including a charge transport material and a charge generation material. The function separate type organic photoconductor mainly used these days comprises the CGL and the CTL successively laminated on a conductive substrate and has a large sensitivity and a high mechanical strength.

The charge transport material used in the photoconductor is required to have high carrier mobility. Since most of the charge transport materials with high carrier mobility are hole transport materials, all the practical organic photoconductors including such a charge transport material are always negatively charged. However, when a negative charge is produced on the surface of such an organic photoconductor, a large amount of ozone is produced due to a reaction with oxygen in air, since the charge is caused by a negative corona discharge, resulting in problems of environmental contamination and degradation of the photoconductor to be obtained. Moreover, a special charging system for preventing the generation of ozone, a decomposition system for the generated ozone, a system for exhausting the ozone from the apparatus and the like are required in order to solve the above-mentioned problems, resulting in a complicated process and system.

The multilayer type photoconductor requires two coating processes for forming the photosensitive layer. Moreover, an interface is present between the CGL and the CTL. Such an interface tends to cause an interference fringe.

As a charge transport material for overcoming the above-mentioned disadvantages, use of an electron transport material is proposed. For example, Japanese Laid-Open Patent Publication No. 1-206349 discloses the use of a compound having a diphenoquinone structure as the charge transport material.

However, the electron transport materials including diphenoquinones generally have a poor compatibility with a binding resin, resulting in lengthening the hopping distance of an electron. Therefore, an electron has difficulty in moving within an electric field with a low voltage, and the residual potential is fairly high. Thus, a photoconductor utilizing a practical electron transport material is desired to be developed.

On the other hand, a photoconductor which can be charged with a desired polarity, i.e., either positively or negatively, has a wider range of application. As a result, the foregoing various disadvantages can be overcome.

Moreover, the monolayer organic photoconductor including the electron transport material and the like dispersed therein can be easily produced and has a number of advantages in the prevention of coating defects and improvement of optical characteristics of the photoconductor.

SUMMARY OF THE INVENTION

The electrophotographic organic photoconductor of the invention comprises a conductive substrate and an organic photosensitive layer formed on the conductive substrate, wherein the organic photosensitive layer includes, as electron transport materials, a diphenoquinone derivative A and a diphenoquinone derivative B having a larger absolute value for reduction potential than that of the diphenoquinone derivative A, and the diphenoquinone derivative B is included in the proportion of 3 to 50 wt % on the basis of the total weight of the electron transport materials.

In one embodiment, the organic photosensitive layer is a monolayer made of a resin composition including a charge generation material, a hole transport material, electron transport materials and a binding resin.

In one embodiment, the electron transport material is included in the proportion of 10 to 80 wt % on the basis of the weight of the binding resin.

In one embodiment, the diphenoquinone derivative A is represented by a general formula selected from the group consisting of the following Formulas 1 through 3, and the diphenoquinone derivative B is represented by the following general Formula 4:

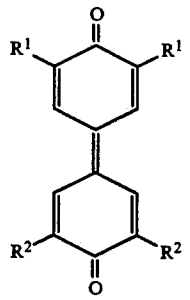

(1)

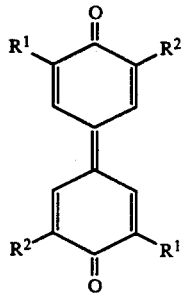

(2)

-continued (3)

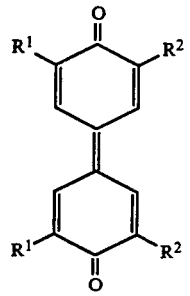

(4)

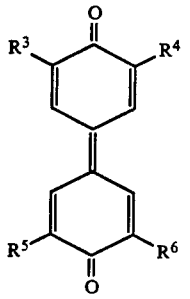

wherein $R^1$ through $R^6$ are independently hydrogen, alkyl, alkoxy, aryl, alalkyl, cycloalkyl, amino or substituted amino; $R^1$ and $R^2$ are different from each other; and $R^3$ through $R^6$ can be different from one another, or two alone, or three or four of $R^3$ through $R^6$ can be identical to one another.

In one embodiment, the diphenoquinone derivative A is 3,5-dimethyl-3',5'-di-t-butyl-4,4'-diphenoquinone.

In one embodiment, the diphenoquinone derivative B is 3,3',5,5'-tetra-t-butyl-4,4'-diphenoquinone.

In one embodiment, the hole transport material has an ionization potential of 5.3 to 5.6 eV.

In one embodiment, the charge generation material has an ionization potential of 5.3 to 5.6 eV.

In one embodiment, the charge generation agent is included in the proportion of 0.1 to 10 wt % on the basis of the weight of the binding resin.

In one embodiment, the hole transport material is alkyl substituted triphenyldiamine.

In one embodiment, the charge generation material is an X-type metal free phthalocyanine.

In one embodiment, the diphenoquinone derivative B is included in the proportion of 5 to 25 wt % on the basis of the total weight of the electron transport materials.

In one embodiment, a difference between the reduction potentials of the diphenoquinone derivative A and the diphenoquinone derivative B is 0.03 V or more.

Thus, the invention described herein makes possible the advantages of (1) providing an electrophotographic organic photoconductor having an extremely low residual potential and excellent sensitivity by using a combination of two specific kinds of diphenoquinone derivatives in a specific ratio as electron transport materials; (2) providing an electrophotographic organic photoconductor which can realize a rapid operation of a copying machine, a printer or the like; (3) a monolayer type organic photoconductor having a low residual potential and improved sensitivity by using a hole transport material with an ionization potential of 5.3 to 5.6 eV, preferably 5.32 to 5.56 eV, together with the above-mentioned diphenoquinone derivatives; and (4) providing an electrophotographic organic photoconductor of a monolayer dispersion type which can be charged with a desired polarity, i.e., either positively or negatively.

These and other advantages of the present invention will become apparent to those skilled in the art upon reading and understanding the following detailed description with reference to the accompanying figures.

DESCRIPTION OF THE PREFERRED EMBODIMENTS

The present inventors have found that a residual potential of a photoconductor is markedly reduced and the sensitivity thereof is improved by using a mixture of two specific diphenoquinone derivatives in a specific ratio as electron transport materials. The present invention is thus accomplished.

The diphenoquinone derivatives are used as the electron transport materials in the present invention because they are more excellent in their electron transferring property than conventional electron transport materials. The reason for the excellent electron transferring property of the diphenoquinone derivatives is as follows: Quinone type oxygen atoms having excellent electron accepting property are bound to both terminals of a molecular chain of a diphenoquinone derivative. Moreover, double bonds are conjugated within the entire molecular chain. As a result, electrons are allowed to easily move in the molecular structure of the diphenoquinone derivative and are readily transferred and accepted between the molecules of the diphenoquinone derivatives.

Diphenoquinone has a low solubility in a solvent to be used in forming a photosensitive layer and also has a low compatibility with a binding resin used as a medium in a photosensitive layer because of its symmetric and stiff molecular structure. The diphenoquinone derivative having a substituent such as alkyl and aryl has an improved solubility in a solvent and compatibility with a binding resin as compared with diphenoquinone having no such substituent. Especially, a diphenoquinone derivative having asymmetric substituents can be dispersed in a photosensitive layer at a higher concentration. Moreover, a fixed relationship was found between the absolute values for reduction potential and the weight ratio of the diphenoquinone derivatives to be used together and the residual potential of a photoconductor produced by using the diphenoquinone derivatives. The low residual potential indicates that the photoconductor has high apparent sensitivity. As a result, it was found that a photoconductor having a minimized residual potential can be obtained by using a combination of a diphenoquinone derivative A and a smaller amount of a diphenoquinone derivative B having a larger absolute value for reduction potential.

Figure 1:
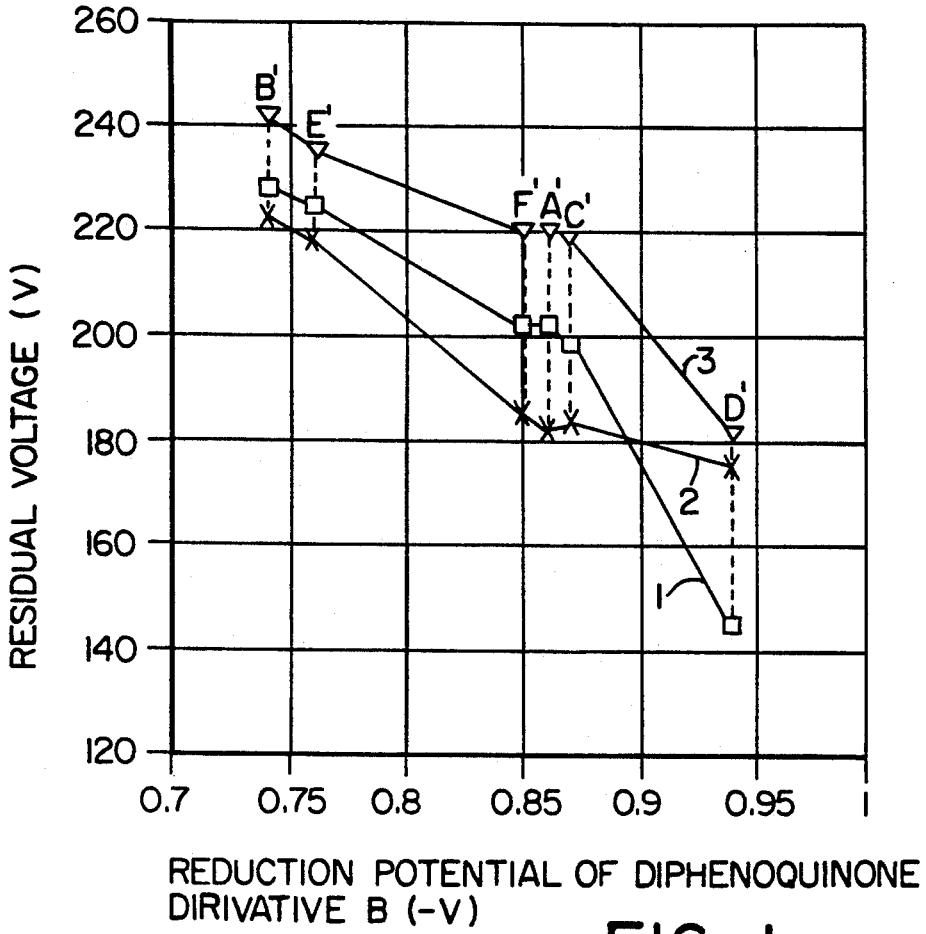
FIG. 1 is a graph showing the relationship between the reduction potential of a diphenoquinone derivative B and the residual potential of a photosensitive member including the diphenoquinone derivative B.

FIG. 1 is a graph obtained by plotting the relationship between a reduction potential (−V) of an electron transport material (diphenoquinone derivative B) and the residual potential after electrification and exposure in a monolayer type organic photoconductor. This photoconductor has a photosensitive layer comprising a charge generation material (X-type metal free phthalocyanine), diphenoquinone derivatives A and B selected from various diphenoquinone derivatives, and a hole transport material (3,3'-dimethyl-N,N,N',N'-tetrakis-4-methylphenyl(1,1'-biphenyl)-4,4'-diamine) in a predetermined weight ratio. The weight ratio is, as in Example 4 described below, 3 parts by weight of the charge generation material, 50 parts by weight of the hole transport material, 40 parts by weight of the diphenoquinone derivative A and 10 parts by weight of the diphenoquinone derivative B.

In FIG. 1, Plot 1 indicates the change in the residual potential of an organic photoconductor obtained by using 3,5-dimethyl-3',5'-di-t-butyl-4,4'diphenoquinone having a reduction potential of −0.86 V as the diphenoquinone derivative A and one of diphenoquinone derivatives a through f described below as the diphenoquinone derivative B.

Point on a longitudinal line A' in FIG. 1 indicates a residual potential of a photoconductor obtained by using the diphenoquinone derivative a. Point on a longitudinal line B' indicates that obtained by using the diphenoquinone derivative b, one on C' indicates that obtained by using the diphenoquinone derivative c, one on D' indicates that obtained by using the diphenoquinone derivative d, one on E' indicates that obtained by using the diphenoquinone derivative e, and one on F' indicates that obtained by using the diphenoquinone derivative f.

For example, Point B' on Plot 1 indicates the residual potential of an organic photoconductor having a photosensitive layer comprising 3,5-dimethyl-3',5'-di-t-butyl-4,4'-diphenoquinone as the diphenoquinone derivative A and the diphenoquinone derivative b, that is, 3,5'-diphenyl-3',5-di-t-butyl-4,4'-diphenoquinone as the diphenoquinone derivative B in the proportion of 25 wt % on the basis of the weight of the diphenoquinone derivative A (i.e., 20 wt % on the basis of the total weight of the diphenoquinone derivatives A and B). Point A' on Plot 1 indicates the residual potential of an organic photoconductor having a photosensitive layer comprising only the diphenoquinone derivative A, that is, 3,5-dimethyl-3',5'-di-tbutyl-4,4'-diphenoquinone, alone.

Similarly, Plot 2 indicates a change in the residual potential of a photoconductor obtained by using 3,5'-diphenyl-3',5-di-t-butyl-4,4'-diphenoquinone having a reduction potential of −0.74 V as the diphenoquinone derivative A and one of the diphenoquinone derivatives a through f described below as the diphenoquinone derivative B.

Plot 3 indicates a change in the residual potential of a photoconductor obtained by using 3,5-dimethoxy-3',5'-di-t-butyl-4,4'-diphenoquinone having a reduction potential of −0.87 V as the diphenoquinone derivative A and one of the diphenoquinone derivatives a through f as the diphenoquinone derivative B.

The diphenoquinone derivatives a through f used for plotting the graph in FIG. 1 are as follows:

The diphenoquinone derivative a: 3,5-dimethyl-3',5'-di-t-butyl-4,4'-diphenoquinone having a reduction potential of −0.86 V.

The diphenoquinone derivative b: 3,5'-diphenyl-3',5-di-t-butyl-4,4'-diphenoquinone having a reduction potential of −0.74 V.

The diphenoquinone derivative c: 3,5-dimethoxy-3',5'-di-t-butyl-4,4'-diphenoquinone having a reduction potential of −0.87 V.

The diphenoquinone derivative d: 3,3',5,5'-tetra-t-butyl-4,4'-diphenoquinone having a reduction potential of −0.94 V.

The diphenoquinone derivative e: 3,5 '-bis(α,α,γ,γ-tetramethylbutyl)-3',5-diphenyl-4,4'-diphenoquinone having a reduction potential of −0.76 V.

The diphenoquinone derivative f: 3,5'-bis(α-dimethylbenzyl)-3',5-di(α-methylpropyl)-4,4'-diphenoquinone having a reduction potential of −0.85 V.

As is obvious from FIG. 1, the residual potential of a photoconductor can be kept at a low level and the sensitivity thereof can be improved by using two kinds of the diphenoquinone derivatives having different absolute values for reduction potential, using the diphenoquinone derivative with a larger absolute value for reduction potential in a smaller amount.

The photoconductor obtained by using a combination of the diphenoquinone derivatives indicated by the point on D' on Plot 1 in FIG. 1 will now be described in detail as an example.

As described above, when the diphenoquinone derivative d (i.e., 3,3',5,5'-tetra-t-butyl-4,4'-diphenoquinone) alone is used as the electron transport material, electrons released from the electron generation material can be readily implanted into the diphenoquinone derivative. However, the diphenoquinone derivative d is inferior to the diphenoquinone derivative a (i.e., 3,5-dimethyl-3',5'-di-t-butyl-4,4'-diphenoquinone) in solubility in a solvent and compatibility with a binding resin.

On the contrary, when the diphenoquinone derivative a alone is used as the electron transport material, although it can be dispersed in a binding resin at a higher concentration, some portions of the diphenoquinone derivative a dispersed in the binding resin do not contribute to the electron implantation, thereby decreasing the electron implantation efficiency.

However, by combining them in a specific ratio, a synergistic effect is produced. The portion which does not contribute to the electron implantation when the diphenoquinone derivative a alone is used is improved to contribute to the electron implantation through the addition of the diphenoquinone derivative d. As a result, an organic photoconductor having a low residual potential and improved sensitivity can be obtained.

Figure 2:
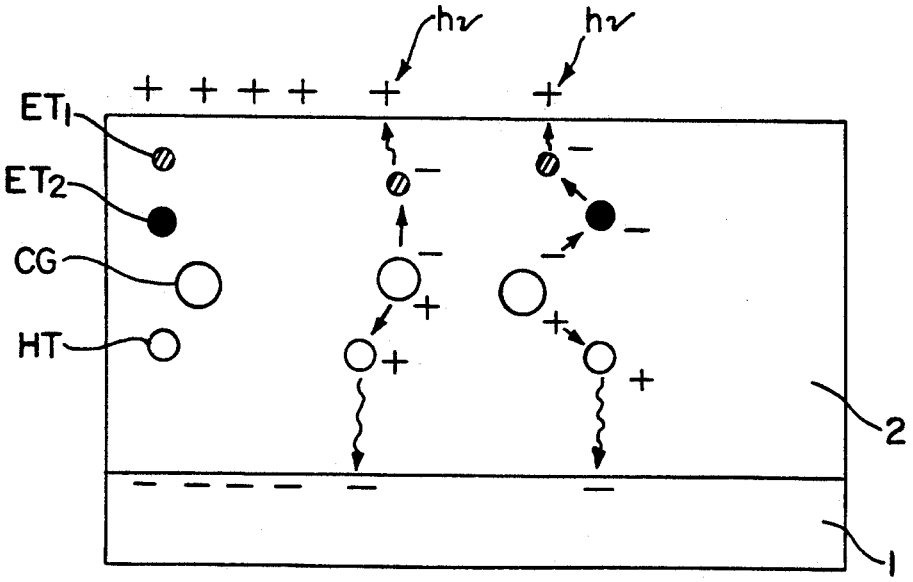
FIG. 2 is a sectional view of an example of a monolayer type organic photoconductor according to the present invention wherein the operation of the photoconductor is shown.
Figure 3:
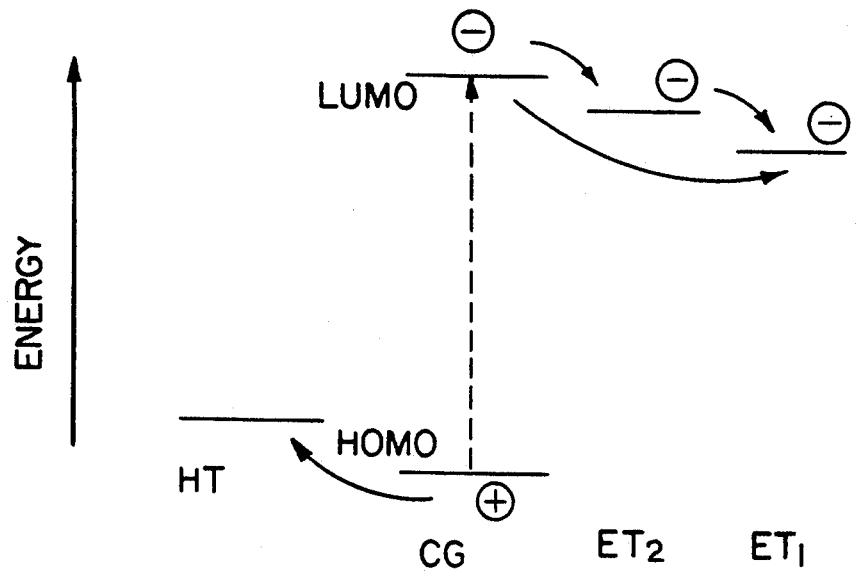
FIG. 3 shows the movement of an electron in a monolayer type organic photoconductor comprising a charge generation material, two kinds of diphenoquinone derivatives and a hole transport material in a predetermined ratio.

FIGS. 2 and 3 show a principle for latent image formation in a monolayer type organic photoconductor according to the present invention.

In FIG. 2, a monolayer type photosensitive layer 2 is provided on a conductive substrate 1. In the organic photosensitive layer 2, a charge generation material CG, an electron transport material ET1 (diphenoquinone A), an electron transport material ET2 (diphenoquinone B) and a hole transport material HT are dispersed.

The surface of the photosensitive layer 2 is positively (+) charged in electrification prior to exposure, thereby inducing negative charges (−) on the surface of the conductive substrate 1. At this point, a ray (hγ) irradiates the surface of the photoconductor, thereby generating charges in the charge generation material CG. One type of electrons are implanted into the electron transport material ET1 through the electron transport material ET2, and the other type of electrons are directly implanted into the electron transport material ET1. The electrons are moved onto the surface of the organic photosensitive layer 2 by these two routes, thereby neutralizing the positive charges (+) thereon. On the other hand, holes (+) are implanted into the hole transport material HT, moved onto the surface of the conductive substrate 1 without being trapped, and neutralized by the negative charges (−) thereon.

Namely, as is shown in FIG. 3, some electrons released from the charge generation material CG by the exposure are not implanted into the electron transport material ET1 when the conventional diphenoquinone derivative alone is used. However, these electrons are first implanted into the electron transport material ET2 (i.e., diphenoquinone derivative B) used in the present invention, which has an excellent implantation efficiency and has a comparatively large absolute value for reduction potential. Then, these electrons are readily implanted into the electron transport material ET1 (i.e., diphenoquinone derivative A). In this manner, more electrons are implanted into the electron transport material ET1 (i.e., diphenoquinone derivative A) via the electron transport material ET2 (i.e., diphenoquinone derivative B). Thus, the electron implantation efficiency into the electron transport material is improved, resulting in the higher sensitivity of the photoconductor.

As is described above, the diphenoquinone derivative B is inferior to the diphenoquinone derivative A in the solubility in a solvent and the compatibility with a binding resin. However, such a problem is solved by adding the diphenoquinone derivative B in the proportion of 3 to 50 wt % based on the total weight of the electron transport materials (diphenoquinone derivatives A and B ). Even if a small amount of the diphenoquinone derivative B is added, the total amount of the electrons implanted into the diphenoquinone derivative A in the end is larger than the case where the diphenoquinone derivative B is not used. Moreover, since the diphenoquinone derivative B has a larger absolute value for reduction potential than the diphenoquinone derivative A, which mainly serves as the electron transport material, the diphenoquinone derivative B does not trap the electrons.

The diphenoquinone derivative A used in the present invention is preferably an asymmetric substitutional type diphenoquinone derivative represented by any of the following general Formulas 1, 2 or 3, and the diphenoquinone derivative B is preferably represented by the following general Formula 4:

(1)

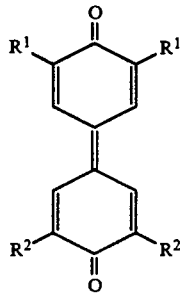

-continued (2)

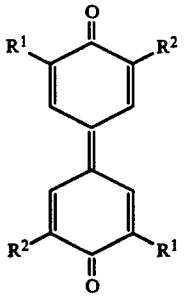

(3)

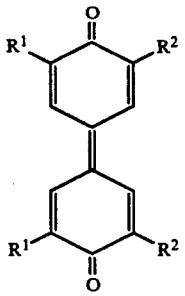

(4)

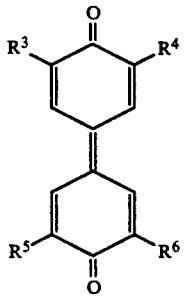

wherein $R^1$ through $R^6$ are independently hydrogen, alkyl, alkoxy, aryl, alalkyl, cycloalkyl, amino or substituted amino; $R^1$ and $R^2$ are different from each other; and $R^3$ through $R^6$ can be different from one another, or two alone, or three or four of $R^3$ through $R^6$ can be identical to one another.

Examples of the alkyl include lower alkyls such as methyl, ethyl, n-propyl, isopropyl, n-butyl, isobutyl, and t-butyl.

Especially, a symmetric diphenoquinone derivative wherein $R^3$ through $R^6$ are all identical to one another is preferable.

Unlimited examples of the diphenoquinone derivative A include 3,5-dimethyl-3',5'-di-t-butyl-4,4'-diphenoquinone, 3,3'-dimethyl-5,5'-di-t-butyl-4,4'-diphenoquinone, and 3,5'-dimethyl-3',5-di-t-butyl-4,4'-diphenoquinone. These diphenoquinone derivatives having the substituents are preferred, because an interaction between the molecules are small due to the low symmetry of the molecules, resulting in an excellent solubility. These diphenoquinone derivatives A can be used singly or a combination of two or more of them can be used.

The diphenoquinone derivative B used in the present invention is preferably one represented by the general Formula 4. Unlimited examples include 3,3',5,5'-tetramethyl-4,4'-diphenoquinone, 3,3',5,5'-tetra-ethyl-4,4'-diphenoquinone, and 3,3',5,5'-tetra-t-butyl-4,4'-diphenoquinone. These diphenoquinone derivatives B can be used singly or a combination of two or more of them can be used.

A difference in the absolute values for reduction potential of the two kinds of diphenoquinone derivatives is preferably 0.03 V or more.

The mixing ratio of the diphenoquinone derivative B on the basis of the total weight of the electron transport materials, that is, generally the total weight of the diphenoquinone derivatives A and B, is preferably 3 to 50 wt %, and more preferably 5 to 25 wt %. When the mixing ratio of the diphenoquinone derivative B is less than 3 wt %, the effectiveness in decreasing the residual potential of the photosensitive layer is not sufficient as will be described below. In addition, the effect to improve the sensitivity is not sufficient. If the mixing ratio of the diphenoquinone derivative B exceeds 50 wt %, a further effect can not be expected. Moreover, the diphenoquinone derivatives are crystallized in such a ratio, and therefore, the resultant organic photoconductor can not be practically used.

The hole transport material used in the present invention is a conventionally known hole transport material. Examples include nitrogen containing cyclic compounds such as oxadiazole compounds, styryl compounds, carbazole compounds, pyrazoline compounds, hydrazone compounds, triphenylamine compounds, indole compounds, oxazole compounds, isoxazole compounds, thiazole compounds, thiadiazole compounds, imidazole compounds, pyrazole compounds and triazole compounds; organic polysilane compounds; and condensed polycyclic compounds.

Among the above hole transport materials, those having an ionization potential of 5.3 to 5.6 eV are preferred. Moreover, those having a mobility of $10^{-6}$ Vcm or more at an electric field strength of $3\times10^5$ V/cm are more preferred. More specifically, alkyl substituted triphenyldiamine is preferable.

The ionization potential was measured by an atmospheric photoelectric analyzing apparatus (produced by Riken Instrument Co., Ltd.; AC-1).

Unlimited examples of the hole transport material used in the present invention include 1,1-bis(p-diethylaminophenyl)-4,4-diphenyl-1,3-butadiene, N,N'-bis-(o,p-dimethylphenyl)-N,N'-diphenylbenzidine, 3,3'-dimethyl-N,N,N',N'-tetrakis-4-methylphenyl(1,1'-biphenyl)-4,4'-diamine, N-ethyl-3-carbazolylaldehyde-N,N'-diphenylhydrazone, and 4-[N,N-bis(p-toluyl-)amino]-β-phenylstilbene.

It was found that a hole transport material having the ionization potential in the above-mentioned range can reduce the residual potential of the resultant photoconductor and improve the sensitivity thereof. The reason for causing such characteristics is not limited to but considered to be as follows:

Whether or not the charges can be readily implanted into the hole transport material from the charge generation material largely depends upon the ionization potential of the hole transport material. When the ionization potential of the hole transport material exceeds 5.6 eV, only a small amount of the charges are implanted from the charge generation material to the hole transport material or only a small amount of the holes are transferred and accepted between the molecules of the hole transport material. As a result, the sensitivity of the resultant photoconductor is degraded.

In the system including both the hole transport material and the electron transport material, attention should be paid to the interaction between them, especially to a formation of a charge-transfer complex. When a charge-transfer complex is formed of the hole transport material and the electron transport material, the mobility of the charges as a whole is degraded because the holes and the electrons are recombined.

When the ionization potential of the hole transport material is less than 5.3 eV, a complex is likely to be formed of the hole transport material and the electron transport material. Thus, since the holes and the electrons are recombined as described above, the apparent quantum yield is reduced, resulting in lowering the sensitivity of the photoconductor.

Therefore, the diphenoquinone derivatives gains steric hindrance by incorporating a substituent, especially a bulky substituent, into the diphenoquinone skeleton. As a result, a complex is prevented from being formed of the hole transport material and the electron transport material.

Examples of the charge generation material to be used in the present invention include selenium, selenium-tellurium, amorphous silicon, pyrrylium salt, azo dyes, disazo dyes, anthanthrone dyes, phthalocyanine dyes, indigo dyes, threne-type dyes, toluidine dyes, pyrazoline dyes, perylene dyes, and quinacridone dyes. These dyes can be used singly or a combination of two or more of them can be used so as to have an absorption wavelength in a desired region. The charge generation material having the ionization potential of 5.3 to 5.6 eV are preferred. An X-type metal free phthalocyanine and oxotitanyl phthalocyanine are particularly preferred.

When the hole transport material to be used in this invention together with the charge generation material has the ionization potential of 5.3 to 5.6 eV, the charge generation material has an ionization potential balanced with that of the hole transferring medium. Specifically, the ionization potential of the charge generation material is 5.3 to 5.6 eV, and preferably 5.32 to 5.38 eV to attain a small residual potential and an improved sensitivity of the photoconductor.

Various kinds of known resins conventionally used in an organic photosensitive layer can be used as a binding resin for dispersing the foregoing materials in the organic photosensitive layer of the present invention. Examples of the binding resin include styrene type polymers, acrylic type polymers, styreneacrylic type copolymers, ethylene-vinyl acetate type copolymers; olefine type copolymers such as polypropylene and ionomer; polyvinyl chloride, vinyl chloridevinyl acetate copolymers, polyester, alkyd resins, polyamide, polyurethane, epoxy resins, polycarbonate, polyallylate, polysulfone, diallylphthalate resins, silicone resins, ketone resins, polyvinyl butylal resins, polyether resins, phenol resins; and thermosetting resins such as epoxy acrylate.

These binding resins can be used singly or a combination of two or more of them can be used. Preferable binding resins are styrene type polymers, acrylic type polymers, styrene-acrylic type copolymers, polyester, alkyd resins, polycarbonate and polyallylate.

In the photoconductor according to the present invention, the charge generation material is used in the proportion of 0.1 to 10 wt % on the basis of the weight of the binding resin, and more preferably 0.5 to 5 wt %. The electron transport materials (the diphenoquinone derivatives A and B ) are used in the proportion of 0.1 to 80 wt % on the basis of the weight of the binding resin, and more preferably 30 to 60 wt %.

The hole transport material is included in the photosensitive layer in the proportion of 5 to 80 wt % based on the weight of solid components, and more preferably 20 to 50 wt %. Moreover, the weight ratio of the electron transport materials (diphenoquinone derivatives A and B) to the hole transport material is in the range of 1:9 to 9:1, and more preferably 2:8 to 8:2.

The resin composition for forming the organic photosensitive layer can further include various known components such as an antioxidant, a radical trapping agent, a singlet quencher, a UV absorber, a softener, a surface modifier, a flatting agent, an extender, a thickener, a dispersion stabilizer, a wax, an acceptor, and a doner when such addition does not badly affect the electrophotographic characteristics.

Especially, when a phenol type antioxidant with steric hindrance is mixed in the resin composition in the proportion of 0.1 to 20 wt % based on the solid components, durability of the photosensitive layer can be remarkably improved without badly affecting the electrophotographic characteristics. Suitable antioxidants are 2,6-di-t-butyl-p-cresol, triethylene glycolbis[3-(3-t-butyl-5-methyl-4-hydroxyphenyl)propionate], pentaerythrityl-tetrakis[3-(3,5-di-t-butyl-4-hydroxyphenyl)-propionate], octadecyl-3-(3,5-di-t-butyl-4-hydroxyphenyl)propionate, 4,4'-butyliden-bis-(3-methyl-6-t-butyl-phenol), 2-(3,5-di-t-butyl-4-hydroxybenzyl)-2-n-butyl malonic acid bis(1,2,2,6,6-pentamethyl-4-piperidine), 2-t-butyl-6-(3'-t-butyl-5'-methyl-2'-hydroxybenzyl)-4-methylphenyl acrylate, and 3,9-bis[1,1-dimethyl-2-{β-(3-t-butyl-4-hydroxy-5-methylphenyl)propionyloxy}ethyl]-2,4,8,10-tetraoxaspiro [5,5]undecane.

As the conductive substrate used in the organic photoconductor according to the present invention, various conductive materials can be used. Examples of the material for the conductive substrate include metals such as aluminum, copper, tin, platinum, gold, silver, vanadium, molybdenum, chromium, cadmium, titanium, nickel, indium, stainless steel, and brass; plastic materials on which one of the above-mentioned metals is evaporated or laminated; and glass coated with aluminum iodide, tin oxide, indium oxide or the like. Since the monolayer type organic photoconductor according to the present invention does not have the interference fringe and the like, an ordinary aluminum tube, especially one subjected to an alumite treatment for forming a layer with a thickness of 1 to 50 μm thereon, can be used.

The organic photoconductor according to the present invention can be produced by coating a conductive substrate with a coating solution containing the resin composition including the above-mentioned materials dissolved or dispersed in a solvent, and drying the resultant substrate.

The coating solution can be prepared by any conventional method, for example, by using a dispersing device such as a roll mill, a ball mill, an attritor, a paint shaker and an ultrasonic dispersing device. The obtained coating solution can be coated on a conductive substrate by a conventional method.

Various kinds of organic solvents can be used as a solvent used in the preparation of the coating solution. Examples of the solvent include alcohols such as methanol, ethanol, isopropanol and butanol; aliphatic hydrocarbons such as n-hexane, octane, and cyclohexane; aromatic hydrocarbons such as benzene, toluene, and xylene; halogenated hydrocarbons such as dichloromethane, dichloroethane, carbon tetrachloride, and chlorobenzene; ethers such as dimethyl ether, diethyl ether, tetrahydrofuran, ethylene glycol dimethyl ether, and diethylene glycol; ketones such as acetone, methyl ethyl ketone, and cyclohexanone; esters such as ethyl acetate and methyl acetate; dimethyl formamide, and dimethyl sulfoxide. These solvents can be used singly or a combination of two or more of them can be used.

The organic photoconductor according to the present invention can be applied to both a monolayer type and a multilayer type photoconductors. Preferably, the present invention is applied to a monolayer type photoconductor because the effect of the combination of the diphenoquinone derivatives A and B is remarkably exhibited in a monolayer type organic photosensitive layer.

In a multilayer type photoconductor, the thickness of the CGL is preferably 0.01 to 5 μm, and more preferably 0.1 to 3 μm. The thickness of the electron transferring layer is preferably 10 to 40 μm.

In a monolayer type photoconductor, the thickness of the photosensitive layer is 5 to 100 μm, and more preferably 10 to 40 μm.

A barrier layer can be formed between the conductive substrate and the photosensitive layer in a monolayer type photoconductor, and between the conductive substrate and the CGL, between the conductive substrate and the CTL or the CGL and the CTL in a multilayer type photoconductor, when the characteristics of the photoconductor are not harmed by such a barrier layer. A protecting layer can be formed on the surface of the photoconductor.

EXAMPLES

The present invention will now be described by way of examples.

(A) Materials to be used:

The following materials are used in the examples described below.

Charge Generation Material (CGM):

I: X-type metal free phthalocyanine
(Ionization potential: 5.38 eV)

II: Oxotitanyl phthalocyanine
(Ionization potential: 5.32 eV)

Hole Transport Material (HT):

1) N,N'-bis-2,4-dimethylphenyl-N,N'-diphenyl benzidine (Ionization potential: 5.43 eV)

2) 3,3'-dimethyl-N,N,N',N'-tetrakis-4-methyl phenyl(1,1'-biphenyl)-4,4'-diamine
(Ionization potential: 5.56 eV)

Electron Transport Material (Diphenoquinone Derivative):

a: 3,5-dimethyl-3',5'-di-t-butyl-4,4'-diphenoquinone (Reduction potential: −0.86 V)

b: 3,5'-diphenyl-3',5-di-t-butyl-4,4'-diphenoquinone (Reduction potential: −0.74 V)

c: 3,5-dimethoxy-3',5'-di-t-butyl-4,4'-diphenoquinone (Reduction potential: −0.87 V)

d: 3,3',5,5'-tetra-t-butyl-4,4'-diphenoquinone (Reduction potential: −0.94 V)

e: 3,5'-bis(α,α,γ,γ-tetramethylbutyl)-3',5-diphenyl-4,4'-diphenoquinone (Reduction potential: −0.76 V)

f: 3,5'-bis(α-dimethylbenzyl)-3',5-di(α-methylpropyl)-4,4'-diphenoquinone (Reduction potential: −0.85 V)

(B) Measurement of a reduction potential:

The reduction potential was measured by cyclic voltammetry with three-electrodes by using the following:

| | |
|---|---|
| Electrodes: | |
| Working electrode: | Glassy carbon |
| Counter electrode: | Platinum |
| Reference electrode: | Silver-silver nitrate (an acetonitrile solution including 0.1 mol/liter of $AgNO_3$) |
| Measuring solution: | |
| A measuring solution was prepared from the following: | |
| Electrolyte: | t-Butyl ammonium perchlorate (0.1 mol) |
| Material to be measured: | Electron transport material (0.001 mol) |
| Solvent: | $CH_2Cl_2$ (1 liter) |

Figure 4:
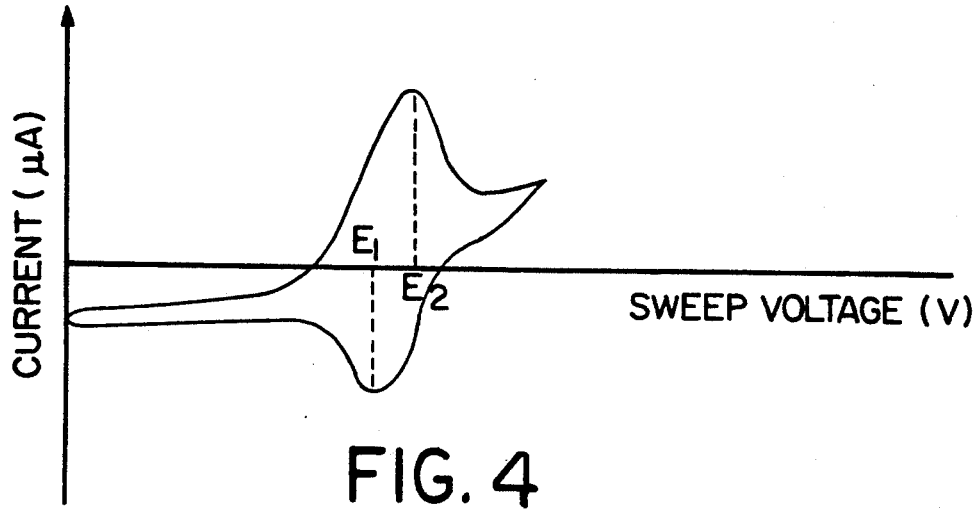
FIG. 4 shows the relationship between a sweep voltage (V) of a diphenoquinone derivative and a current ($\mu$A) for calculation of a reduction potential.

Calculation of a reduction potential:

The relationship between a sweep voltage (V) and a current (μA) is obtained to make a graph as shown in FIG. 4. On this graph, values of E1 and E2 are measured, thereby calculating the reduction potential from the following equation:

$$\text{Reduction potential} = (E1 + E2)/2 \text{ (V)}$$

(C) Evaluation of an electrophotographic photoconductor:

By using an electrostatic copy testing apparatus (produced by Kawaguchi Electric Co., Ltd.; EPA-8100), a voltage was applied to a photoconductor obtained in each Example or Comparative Example to charge it positively or negatively. The electrophotographic characteristics of the photoconductor were determined through an exposure by using a white halogen lamp as a light source.

In Tables 1 and 2 below showing the results of the evaluation, "V1 (V)" indicates an initial potential on the surface of a charged photoconductor. "V2 (V)" indicates potential on the surface of the photoconductor measured as a residual potential one second after the start of the exposure. "E1/2 (lux.sec.)" indicates a half-valued light exposure calculated from the time required to halve the initial potential V1 (V).

(D) Production of an electrophotographic photoconductor:

Compounds used in each Example or Comparative Example as the CG, the HT and the diphenoquinone derivatives A and B are shown in Tables 1 and 2 below.

EXAMPLES 1-4, 8-16, COMPARATIVE EXAMPLE 1-5 AND 7-11

Three parts by weight of the CG, 50 parts by weight of the HT, the diphenoquinone derivatives A and B in the proportions as shown in Table 1 or 2, 100 parts by weight of polycarbonate as the binding resin, and a predetermined amount of dichloromethane as the solvent were mixed and dispersed in a ball mill to obtain a coating solution for a monolayer type photosensitive layer to be used in each of these Examples and Comparative Examples.

Each of the obtained coating solutions was coated on an aluminum foil with a wire bar. The resultant aluminum foil was dried with warm air at 100° C. for 60 minutes to form a photosensitive layer with a thickness of 15 to 20 μm thereon. Thus, an electrophotographic monolayer type photoconductor was obtained.

The obtained photoconductors were positively charged and determined for the electrophotographic characteristics by the above-mentioned method. The results are shown in Tables 1 and 2.

EXAMPLES 6, 7 AND COMPARATIVE EXAMPLE 6

Photosensitive members were obtained by using the compounds shown in Table 1 or 2 and evaluated in the same manner as in Example 1 except that the resultant photoconductors were negatively charged. The results are shown in Tables 1 and 2.

EXAMPLE 5 AND COMPARATIVE EXAMPLE 12

Photosensitive members were obtained by using the compounds shown in Table 1 or 2 and evaluated in the same manner as in Example 1 except that 90 parts by weight of the HT was used. The results are shown in Tables 1 and 2.

TABLE 1

| Example | CGM | HT | Diphenoquinone A Kind | Diphenoquinone A Amount | Diphenoquinone B Kind | Diphenoquinone B Amount | Ratio of DQ-B | V1 (V) | V2 (V) | $E_{\frac{1}{2}}$ (lux · sec) |
|---|---|---|---|---|---|---|---|---|---|---|
| 1 | I | 2 | a | 48.5 | d | 1.5 | 3 | +720 | +176 | 1.24 |
| 2 | I | 2 | a | 47.5 | d | 2.5 | 5 | +705 | +168 | 0.953 |
| 3 | I | 2 | a | 45.0 | d | 5.0 | 10 | +705 | +166 | 0.921 |
| 4 | I | 2 | a | 40.0 | d | 10.0 | 20 | +694 | +145 | 0.801 |
| 5 | I | 2 | a | 5.0 | d | 5.0 | 50 | +716 | +205 | 1.31 |
| 6 | I | 2 | a | 47.5 | d | 2.5 | 5 | −715 | −203 | 1.14 |
| 7 | I | 2 | a | 40.0 | d | 10.0 | 20 | −715 | −186 | 0.996 |
| 8 | I | 1 | a | 40.0 | d | 10.0 | 20 | +731 | +153 | 0.813 |
| 9 | II | 2 | a | 40.0 | d | 10.0 | 20 | +686 | +138 | 0.806 |
| 10 | II | 1 | a | 40.0 | d | 10.0 | 20 | +668 | +141 | 0.795 |
| 11 | I | 2 | b | 40.0 | d | 10.0 | 20 | +691 | +175 | 0.841 |
| 12 | I | 2 | b | 40.0 | c | 10.0 | 20 | +697 | +183 | 0.962 |
| 13 | I | 2 | b | 40.0 | a | 10.0 | 20 | +703 | +182 | 0.969 |
| 14 | I | 2 | b | 40.0 | f | 10.0 | 20 | +704 | +185 | 0.973 |
| 15 | I | 2 | c | 40.0 | d | 10.0 | 20 | +717 | +181 | 0.955 |
| 16 | I | 2 | b | 25.0 | a | 25.0 | 50 | +693 | +168 | 0.961 |

CGM: Charge Generation Material
HT: Hole Transport Material $$\text{Ratio of DQ-B (wt \%)} = \frac{B}{A + B} \times 100$$

TABLE 1

| Comparative Example | CGM | HT | Diphenoquinone A Kind | Diphenoquinone A Amount | Diphenoquinone B Kind | Diphenoquinone B Amount | Ratio of DQ-B | V1 (V) | V2 (V) | $E_{\frac{1}{2}}$ (lux · sec) |
|---|---|---|---|---|---|---|---|---|---|---|
| 1 | I | 2 | a | 40.0 | f | 10.0 | 20 | +720 | +202 | 1.26 |
| 2 | I | 2 | a | 40.0 | e | 10.0 | 20 | +717 | +225 | 1.32 |
| 3 | I | 2 | a | 40.0 | b | 10.0 | 20 | +729 | +228 | 1.38 |
| 4 | I | 2 | a | 24.0 | d | 26.0 | 52 | * | * | * |
| 5 | I | 2 | a | 50.0 | None | None | 0 | +723 | +202 | 1.24 |
| 6 | I | 2 | a | 50.0 | None | None | 0 | −736 | −231 | 1.36 |
| 7 | I | 1 | a | 50.0 | None | None | 0 | +725 | +191 | 1.15 |
| 8 | II | 2 | a | 50.0 | None | None | 0 | +695 | +190 | 0.921 |
| 9 | II | 1 | a | 50.0 | None | None | 0 | +670 | +185 | 1.19 |
| 10 | I | 2 | b | 50.0 | None | None | 0 | +725 | +223 | 1.42 |
| 11 | I | 2 | c | 50.0 | None | None | 0 | +731 | +218 | 1.32 |
| 12 | I | 2 | a | 10.0 | None | None | 0 | +721 | +244 | 1.63 |

CGM: Charge Generation Material
HT: Hole Transport Material $$\text{Ratio of DQ-B (wt \%)} = \frac{B}{A + B} \times 100$$

* could not be measured due to crystallization

Tables 1 and 2 reveal the following:

(1) The kind of the diphenoquinone derivative:

In Examples 4 and 8–15, as shown in Table 1, the diphenoquinone derivative B having a larger absolute value for reduction potential than that of the diphenoquinone derivative A is used in the proportion of 20 wt % on the basis of the total weight of the electron transport materials (diphenoquinone derivatives A and B). The resultant photoconductors obtained in these Examples have a residual potential (V2) of 138 to 185 V, and a half-valued light exposure of 0.795 to 0.973 lux.-sec.

The photoconductors of Comparative Examples 1–3 are, as shown in Table 2, identical to those of Examples 4 and 8–15 except that the diphenoquinone derivative B had a smaller absolute value for reduction potential than that of the diphenoquinone derivative A. Such photoconductors have a residual potential (V2) of 202 to 228 V, and a half-valued light exposure of 1.26 to 1.38 lux.-sec.

Accordingly, an electrophotographic organic photoconductor having an extremely low residual potential and excellent sensitivity can be obtained by using, as electron transport materials, a diphenoquinone derivative A and a diphenoquinone derivative B having a larger absolute value for reduction potential than that of the diphenoquinone derivative A, and using the content of the diphenoquinone derivative B in the proportion of 3 to 50 wt % on the basis of the total weight of the electron transport materials.

(2) The contents of the diphenoquinone derivatives:

In Examples 1–5, the diphenoquinone derivative a and the diphenoquinone derivative d having a larger absolute value for reduction potential are used as the electron transport materials. The content of the diphenoquinone derivative d on the basis of the total weight of the electron transport materials is varied in the range of 3 to 50 wt %.

The photoconductor obtained in Comparative Example 4 is identical to that of Example 1 except that the diphenoquinone derivative d is contained in the proportion of 52 wt %. The photoconductor obtained in Comparative Example 5 is identical to that of Example 1 except that the diphenoquinone derivative d is not contained.

Judging from the comparison of the photoconductors obtained in Examples 1–4 with those obtained in Comparative Examples 4 and 5, addition of the diphenoquinone derivative d exhibited a remarkable effect in reducing the residual potential of the photoconductor. However, too large an amount of the diphenoquinone derivative d causes crystallization in the photosensitive layer.

The photoconductors obtained in Examples 8–11 and 15 are identical to those obtained in Comparative Examples 7–11 except that two diphenoquinone derivatives are used in Examples 8–11 and 15. Judging from the comparison of the photoconductors obtained in Examples 8–11 and 15 with those obtained in Comparative Examples 7–11, and the photoconductors obtained Examples 13 and 16 with that obtained in Comparative Example 10, it is found that the above applies to cases where other kinds of charge generation materials and hole transport materials are used.

(3) A difference between the positive charge and the negative charge:

In Examples 2 and 4, the photoconductors were obtained by using a combination of the diphenoquinone derivatives A and B, and positive electrification. In Comparative Example 5, the photoconductor was obtained by using the diphenoquinone derivative B alone and positive electrification. The photoconductors obtained in Examples 6 and 7 and Comparative Example 6 were negatively charged.

From the results of the evaluation of the above-mentioned photoconductors, it is found that the photoconductor according to the present invention exhibits low residual potential and excellent sensitivity, even if the photoconductor is positively charged or negatively charged. On the contrary, although the photoconductors obtained in the Comparative Examples can be charged either positively or negatively, the photoconductor has high residual potential and inferior sensitivity as compared with those obtained in Examples regardless of the polarity of the charge.

(4) The containing ratio of the diphenoquinone derivatives to the hole transport material:

In Example 5, the diphenoquinone derivatives are contained in the proportion of 10 wt % on the basis of the weight of the hole transport material. Judging from the comparison of the photoconductors obtained in these Examples with those obtained in other Examples including the diphenoquinone derivatives in the proportion of 50 wt % on the basis of the weight of the hole transport material, the effect of the combination of the diphenoquinone derivatives A and B is decreased when the content of the diphenoquinone derivatives is small.

However, judging from the comparison of the photoconductors obtained in Example 5 and Comparative Example 12, in which the diphenoquinone derivatives are contained in the proportion of 10 wt % on the basis of the weight of the hole transport material, even if the content of the diphenoquinone derivative B is decreased, the effect of the combination of the diphenoquinone derivatives A and B still remains, although it is decreased.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

We claim:

1. An electrophotographic organic photoconductor comprising a conductive substrate and an organic photosensitive layer formed on the conductive substrate, wherein the organic photosensitive layer is made of a resin composition including a charge generation material, a hole transport material, electron transport materials and a binding resin, the electron transport materials including a diphenoquinone derivative A and a diphenoquinone derivative B having a larger absolute value for reduction potential than that of the diphenoquinone derivative A, and the diphenoquinone derivative B is included in the proportion of 3 to 50 wt % on the basis of the total weight of the electron transport materials;

the hole transport material having an ionization potential of 5.3 to 5.6 eV.

2. An electrophotographic organic photoconductor according to claim 1, wherein the electron transport material is included in the proportion of 10 to 80 wt % on the basis of the weight of the binding resin.

3. An electrophotographic organic photoconductor according to claim 1, wherein the diphenoquinone derivative A is represented by a general formula selected from the group consisting of the following Formulas 1 through 3, and the diphenoquinone derivative B is represented by the following general Formula 4:

(1)

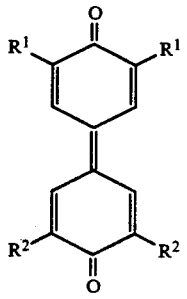

-continued (2)

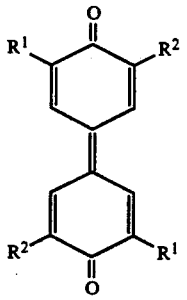

(3)

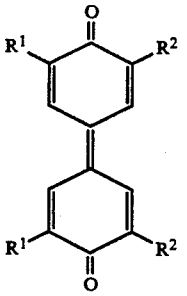

(4)

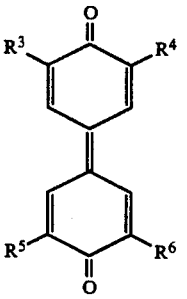

wherein $R^1$ through $R^6$ are independently hydrogen, alkyl, alkoxy, aryl, alalkyl, cycloalkyl, amino or substituted amino; $R^1$ and $R^2$ are different from each other; and $R^3$ through $R^6$ can be different from one another, or two alone, or three or four of $R^3$ through $R^6$ can be identical to one another.

4. An electrophotographic organic photoconductor according to claim 1, wherein the diphenoquinone derivative A is 3,5-dimethyl-3',5'-di-t-butyl-4,4'-diphenoquinone.

5. An electrophotographic organic photoconductor according to claim 1, wherein the diphenoquinone derivative B is 3,3',5,5'-tetra-t-butyl-4,4'-diphenoquinone.

6. An electrophotographic organic photoconductor according to claim 1, wherein the charge generation material has an ionization potential of 5.3 to 5.6 eV.

7. An electrophotographic organic photoconductor according to claim 1, wherein the charge generation agent is included in the proportion of 0.1 to 10 wt % on the basis of the weight of the binding resin.

8. An electrophotographic organic photoconductor according to claim 1, wherein the hole transport material is alkyl substituted triphenyldiamine.

9. An electrophotographic organic photoconductor according to claim 1, wherein the charge generation material is an X-type metal free phthalocyanine.

10. An electrophotographic organic photoconductor according to claim 1, wherein the diphenoquinone derivative B is included in the proportion of 5 to 25 wt % on the basis of the total weight of the electron transport materials.

11. An electrophotographic organic photoconductor according to claim 1, wherein a difference between the reduction potentials of the diphenoquinone derivative A and the diphenoquinone derivative B is 0.03 V or more.

12. An electrophotographic organic photoconductor according to claim 1, wherein the organic photosensitive layer is a monolayer.

13. An electrophotographic organic photoconductor according to claim 1, wherein the organic photosensitive layer is a multilayer comprising a charge generation layer and an electron transport layer.

14. An electrophotographic organic photoconductor according to claim 1, wherein the hole transport material has an ionization potential of 5.32 to 5.56 eV.

15. An electrophotographic organic photoconductor comprising a conductive substrate and an organic photosensitive layer formed on the conductive substrate, wherein the organic photosensitive layer is made of a resin composition including a charge generation material, a hole transport material, electron transport materials and a binding resin, the electron transport materials including a diphenoquinone derivative A and a diphenoquinone derivative B having a larger absolute value for reduction potential than that of the diphenoquinone derivative A, and the diphenoquinone derivative B is included in the proportion of 3 to 50 wt % on the basis of the total weight of the electron transport materials, and the electron transport material being included in the proportion of 10 to 80 wt % on the basis of the weight of the binding resin.

16. An electrophotographic organic photoconductor according to claim 15, wherein the organic photosensitive layer is a monolayer.

17. An electrophotographic organic photoconductor according to claim 15, wherein the organic photosensitive layer is a multilayer comprising a charge generation layer and an electron transport layer.

18. An electrophotographic organic photoconductor according to claim 15, wherein the hole transport material has an ionization potential of 5.32 to 5.56 eV.

* * * * *